United States Patent [19]

Tolley et al.

[11] 4,280,839

[45] Jul. 28, 1981

[54] RECOVERY OF METAL VALUES FROM A METAL BEARING SOURCE OF NICKEL AND VANADIUM

[75] Inventors: William K. Tolley, Alrington Heights; William C. Laughlin, Hoffman Estates, both of Ill.

[73] Assignee: UOP Inc., Des Plaines, Ill.

[21] Appl. No.: 96,130

[22] Filed: Nov. 1, 1979

[51] Int. Cl.[3] ..... B22F 9/00; C22B 23/02

[52] U.S. Cl. ..... 75/82; 252/411 S; 423/62; 423/138

[58] Field of Search ..... 75/84, 82; 252/411 S; 423/62, 138

[56] References Cited

U.S. PATENT DOCUMENTS

| | | | |
|---|---|---|---|
| 4,163,709 | 8/1979 | Burk et al. | 252/411 S |
| 4,203,759 | 5/1980 | Metrailer et al. | 423/62 |

*Primary Examiner*—M. J. Andrews

*Attorney, Agent, or Firm*—James R. Hoatson, Jr.; Raymond H. Nelson; William H. Page, II

[57] ABSTRACT

Metal values may be recovered from metal bearing sources which contain at least two metals, at least one of which is in the form of a sulfide, by treating the aforesaid source with an oxidant at an elevated temperature in the range of from about 600° to about 1500° C. and in the presence of an added promoter comprising a sulfur-containing compound. The treatment will convert at least one metal value to an oxide and at least one metal value is converted to the elemental state which contains a relatively minor amount of a subsulfide. The addition of the sulfur-containing compound will result in an increase in the particle size of the elemental metal, thus permitting the recovery of said metal more readily.

8 Claims, No Drawings

RECOVERY OF METAL VALUES FROM A METAL BEARING SOURCE OF NICKEL AND VANADIUM

BACKGROUND OF THE INVENTION

Desirable metal values are found in a wide variety of metal sources including ores, slags, sands, or petroleum feed stocks. In the latter case, the metals are present as impurities or contaminants. The presence of these organometallic contaminants in petroleum crude oils will exert a deleterious effect upon many catalysts which are utilized when these crude oils are subjected to various processes. Generally speaking, the metal contaminants which are present in these petroleum crude oils will comprise nickel and vanadium although other metals including iron, copper, etc., are also often present. While it is possible to concentrate the metallic contaminants which exist in the crude oils as oxide organo-metallic species or sulfides by currently known techniques, it is relatively difficult to effectively separate the metal values.

The separation of desirable metal values in the form of elemental metals or salts thereof may become commercially attractive due to the desirability of obtaining these purified metals for use in the chemical industry as well as various other industries. For example, in the case of vanadium, vanadium values such as vanadium metal or vanadium oxides are useful for many purposes in the chemical industry. As a specific example of this, vanadium metal may be used as the target material for X-rays, in the manufacture of steel, or in the manufacture of vanadium compounds such as catalysts or alloys. Likewise, vanadium oxides such as vanadium pentoxide are used as the starting material for other vanadium salts, as a catalyst for the oxidation of sulfur dioxide, as a gasoline catalyst, as a catalyst for organic reactions, as a ceramic coloring material, for inhibiting ultraviolet transmission in glass, in black inks, in photographic developers, in dying textiles, in medicines, etc. Heretofore, the obtention of vanadium values from vanadium containing sources has been effected in a wide variety of processes. For example, the vanadium containing material can be subjected to the action of sulfuric acid, sodium oxychloride, hydrochloric acid, nitric acid, etc. In addition, prior methods have also utilized certain ammonium salts such as ammonium chloride, ammonium sulfide, etc., as the precipitating agent whereby insoluble vanadium salts are formed. However, each of these methods possesses certain disadvantages. For example, when utilizing acidic compounds such as hydrochloric acid, nitric acid, sulfuric acid, etc., the problem of clean-up of unwanted chemical compounds necessitates the use of relatively expensive and complicated apparatus in order to avoid the problem of polluting the environment. Conversely, when utilizing ammonium salts such as ammonium chloride as exemplified by the method set forth in U.S. Pat. No. 3,320,024 in which ammoniacal ammonium chloride is used to precipitate ammonium metavanadate, the problem of an eventual buildup of chloride ions is present. This buildup is unwanted in view of the fact that the mother liquor will, after the caustic leach, eventually contain an amount of salt such as alkali chlorides which are of insufficient caustic strength to take the vanadium into solution during the leaching operation.

As will hereinafter be shown in greater detail, it has now been discovered that desirable metal values may be recovered from a metal bearing source which contains a plurality of metal values, at least one of which is in the form of a sulfide, by a relatively simple and economical process.

This invention relates to a process for the recovery of diverse metal values. More specifically the invention is concerned with a process for the recovery of diverse metal values from a metal bearing source which contains a plurality of metal values in various forms, at least one form of which is a sulfide. The recovery or separation of the desired metal values is enhanced by the addition of a promoter compound during the oxidation step of the process.

It is therefore an object of this invention to provide an efficient process for the recovery and separation of desirable metal values.

A further object of this invention is found in a process for the recovery and separation of desirable metal values from a metal bearing source whereby said recovery may be performed in a more efficient fashion.

In one aspect an embodiment of this invention resides in a process for the recovery of metal values from a metal bearing source containing at least two metal values, at least one of which is in the form of a sulfide, which comprises treating said source in the presence of an oxidant selected from the group consisting of carbon dioxide and water and in the presence of an added promoter comprising a sulfur-containing compound to convert at least one metal to an oxide, separating the resulting metal-metal sulfide and at least one metal oxide, and recovering the desired metal values.

A specific embodiment of this invention is found in a process for the recovery of metal values from a metal bearing source containing nickel and vanadium, said nickel being in the form of a sulfide, which comprises treating said source in the presence of carbon dioxide at a temperature in the range of from about 600° to about 1500° C. and in the added presence of sulfur dioxide to convert said nickel sulfide to elemental nickel containing a relatively small amount of a nickel subsulfide and vanadium oxide, separating said elemental nickel containing a nickel sulfide from vanadium oxide and recovering the desired metals.

Other objects and embodiments will be found in the following further detailed description of the present invention.

As hereinbefore set forth, the present invention is concerned with an improvement in a process for the recovery of metal values from a metal bearing source which contains a plurality of metals. The improvement in the recovery process is found in the fact that it has now been discovered when treating the metal bearing source at an elevated temperature with an oxidant such as carbon dioxide or water it is possible to alter the physical form of one of the metal values by effecting the treatment in the presence of a promoter. The promoter which is utilized to alter the physical form of one of the metal values comprises a sulfur-containing compound such as elemental sulfur, sulfur dioxide, etc. The metal value which is effected by the presence of this promoter compound will comprise the metal value which is recovered as the elemental metal which contains a relatively small amount of a metal subsulfide. When effecting the process in the conventional manner, that is, by treating a metal bearing source with an oxidant such as carbon dioxide or water whereby one of the metal values present in the metal bearing source is selectively oxidized to the oxide form while the other metal is converted to the elemental form containing a relatively minor amount of the metal subsulfide, the latter will usually be recovered as particles. However, these particles will be relatively small in size and thus the recovery of the desired metal might be relatively complicated due to the particular apparatus which is required to recover relatively small particles. In contradistinction to this, by utilizing the process of the present invention, that is, by effecting the oxidation treatment in the presence of an added sulfur-containing compound, it is possible to increase the size of these particles thereby rendering the recovery step less complicated and enabling the recovery step of the process to be effected in a relatively economical and simple manner.

The metal bearing sources which may be subjected to the process of the present invention will include, as hereinbefore set forth, ores, slags, sands or petroleum feed stocks. It has now been further discovered that the type of metal bearing source will determine which of the sulfur-containing compounds must be employed in order to effectively alter the particle size of one of the metal values present in the source. In this respect, it has now been discovered that in order to employ sulfur dioxide as the promoter compound some carbon or other appropriate reductant must be present either in the metal bearing source itself or by adding a reductant during the process. Conversely, if there is no carbon present in the metal bearing source, it will be necessary to utilize elemental sulfur as the promoter compound.

The selective oxidation step utilizing an oxidizing agent of the type hereinbefore set forth and a promoter compound is effected at an elevated temperature which may be in the range of from about 600° up to about 1500° C. for a period of time which may range from about 1 to about 20 hours or more in duration. The selective oxidation which is used to treat metal bearing sources in which metals are present in the form of a sulfide will oxidize one or more of the metals while at least one metal which is present remains in the form of a sulfide or which will be reduced to an elemental form containing a relatively minor amount of a subsulfide. Following the selective oxidation of the metal values in the source, it will be possible to effect a separation of various metal values by any conventional means known in the art such as magnetic separation, flotation, differential elution, riffling, sizing, etc.

As an example of the recovery of desired metal values utilizing the process of this invention, a dragstream resulting from the hydrorefining of a hydrocarbon charge stock containing metal contaminants such as nickel and vanadium and which may also contain an added amount of metal contaminant which may be present due to the metallic catalyst which has been used in the hydrocracking reaction is subjected to a solvent extraction. The solvent extraction is effected by passing the dragstream through a solvent such as toluene, the xylenes, pentane, hexane, etc., whereby any light hydrocarbons which are present in the dragstream are removed. Following this the dragstream may, if so desired, be subjected to an additional process for the removal of any volatile material still contained therein by pyrolyzing the material at a temperature in the range of from about 350° to about 550° C. in the presence of a non-oxidizing gas stream such as nitrogen, etc.

The resulting material which comprises a mixture of carbon and the metal contaminants which may be in the form of sulfides such as nickel sulfide and vanadium sulfide are then treated with an oxidant such as steam or carbon dioxide at a temperature in the range of from about 600° to about 1500° C., said treatment being effected in the presence of an added sulfur-containing compound such as sulfur dioxide. The vanadium sulfide which is present in the mixture will be converted to a vanadium oxide such as vanadium trioxide, while the nickel sulfide will be converted to the metallic metal powder which will contain a relatively small amount of some residual sulfur, said product being characterized as a mixture of metallic nickel and a nickel subsulfide. Due to the presence of the added sulfur dioxide the particles of nickel containing the nickel subsulfide will be greater in size than the particles which would have been obtained in the absence of any added sulfur-containing compound. In addition, the carbon which was present in the reaction mixture will react with the carbon dioxide, if this is the oxidizing agent utilized, and some carbon monoxide which may be recovered and passed through an oxidation zone or chamber wherein it is admixed with air or oxygen to form carbon dioxide, this then being utilized as the oxidizing agent in a recycle process.

Alternatively, if the metal bearing source does not contain any carbon, the oxidation treatment of the metal bearing source will be accomplished by utilizing an oxidizing agent of the type hereinbefore set forth plus the addition of elemental sulfur as the promoting compound, the remainder of the oxidizing step being accomplished in a manner similar to that hereinbefore set forth. The mixture of nickel-nickel subsulfide and vanadium trioxide which results from the roasting or oxidizing step herein described may then be separated and recovered. One particular separation step which may be employed will comprise a magnetic separation inasmuch as the nickel-nickel subsulfide mixture is magnetic in nature and due to the relatively large particle size which results from the use of the present process, will be easily separable from the vanadium trioxide compound which itself is non-magnetic in nature.

The process of this invention may be effected in any suitable manner and may comprise either a batch or continuous type of operation. For example, when a batch type of operation is employed, the metal bearing source such as an ore or a dragstream from a hydrocarbon refining process may be subjected to preparative steps prior to being subjected to the mild oxidant roast. For example, an ore may be ground or comminuted to a desired particle size which may be from about ¼ inch to about 400 mesh. The grinding may be accomplished by means of a ball mill, a rolling mill, roll crushers, etc. As hereinbefore set forth, if the metal bearing source is from a hydrocarbon refining process, the volatile material which may still be contained therein is removed by solvent extraction, distillation, pyrolysis, etc., and thereafter the material containing a plurality of metal values at least one of which is in the form of a sulfide is subjected to the oxidation roast in the presence of an oxidant such as carbon dioxide or water and in the presence of an added sulfur-containing compound such as sulfur dioxide or elemental sulfur, the particular choice of promoter compound being dependent upon the nature of the metal bearing source and the oxidizing agent utilized. The decabonization of the source is effected in this step which also results in a selective oxidation of at least one of the metal values to form an oxide thereof, at least one of the other metal values remaining in the sulfide form. The resultant mixture of metal values in different forms is then recovered from this step and subjected to conventional means of separation hereinbefore set forth whereby the desired metal values are recovered.

It is also contemplated within the scope of this invention that the process may be effected in a continuous manner of operation. When this type of operation is employed the metal bearing source is continuously charged to an apparatus wherein it is ground to a preferred particle size. The resulting particles are then continuously withdrawn from this zone and passed to a second zone wherein any volatile material which may still be present in the source is removed utilizing conventional means of the type also hereinbefore set forth in greater detail. After removal of the volatile material the metal bearing source is continuously charged to an oxidation zone wherein it is contacted with a mild oxidant of the type previously discussed and a sulfur-containing compound at an elevated temperature in the range of from about 600° to about 1500° C. After passage through this zone for a predetermined period of time wherein a selective oxidation is effected, the metal values, at least one of which will be in the oxide form, while at least one will be in the elemental metal form, are continuously withdrawn and passed to a separation zone such as a magnetic separator wherein the metal values are separated and recovered. After recovery the metal values may then be converted to the elemental form to an oxide form, etc., whereby they are placed in a form suitable for use in further chemical reactions.

The following examples are given to illustrate the process of this invention. However, it is to be understood that these examples are given merely for purposes of illustration and that the present process is not necessarily limited thereto.

EXAMPLE I

In this example 100 grams of a sample of a dragstream containing nickel and vanadium contaminants in the form of sulfides was roasted for a period of 2 hours at a temperature of 900° C. under steam. Following this, 10 grams of the product which was recovered was mixed with 2 grams of a nickel sulfide and crushed in a mortar and pestle. The sample was then roasted at a temperature of 950° C. for a period of 2 hours under a carbon dioxide stream which contained a small amount of carbon monoxide to remove any oxygen which may be present. At the end of the 2 hour period, the sample was cooled under a carbon dioxide atmosphere. The nickel-nickel subsulfide particles were of 500 micron size.

When the experiment was repeated in a manner similar to that set forth in the above paragraph except that the roasting temperature was 1050° C. for a period of 2 hours under a carbon dioxide atmosphere, the particle size of the nickel subsulfide mixture was approximately 200 microns in size.

A repeat of the experiment utilizing a roasting temperature of 1150° C. resulted in the obtention of nickel-nickel subsulfide particles of approximately 25 micron size.

EXAMPLE II

In this example 10 grams of the mixture of Example I that had been roasted at a temperature of 1150° C. was placed in a quartz boat inside a quartz tube. The tube was then placed in a two-stage horizontal furnace in which sulfur was placed in the first stage. The furnace was heated in such a manner that the sulfur was maintained at 275° C. while the sample was maintained at 950° C. Carbon dioxide was admitted to the furnace at a rate of 500 ml/min. and the sample was roasted for a period of 3.5 hours at the aforementioned temperatures. At the end of this period the sample was recovered and it was determined that the diameter of the particles of the nickel-nickel sulfide portion of the sample was approximately 300 microns in size.

EXAMPLE III

In this example 200 grams of a dragstream sample was roasted at 950° C. for a period of 1 hour under a carbon dioxide atmosphere. Following this 15 grams of a nickel sulfide sample which was screened at 60 mesh was added to the sample and thoroughly admixed therewith.

The sample prepared according to the above paragraph was divided into three 15 gram portions. The first portion of the mixture was placed in zircon boats and heated to a temperature of 950° C. in an oxidizing atmosphere comprising 1 liter/min. of carbon dioxide, 50 ml/min. of sulfur dioxide and about 10 ml/min. of carbon monoxide. The sample was roasted for a period of 2 hours at this time and thereafter cooled under a nitrogen blanket. The resulting sample contained nickel-nickel subsulfide particles which were approximately 100 microns in size, said particles being strongly magnetic.

A second 15 gram sample of mixture was placed in zircon boats and roasted for a period of 2 hours at a temperature of 1150° C. in an oxidizing atmosphere comprising 200 ml/min. each of carbon dioxide and sulfur dioxide along with about 10 ml/min. of carbon monoxide. At the end of the 2 hour period heating was discontinued and the sample was cooled under a nitrogen blanket. The nickel-nickel subsulfide portion of the sample comprised relatively large spheres having a particle size of about 300 microns which were very magnetic in nature.

The third sample was treated in a manner similar to that set forth with respect to the first sample, that is, said sample was oxidized at a temperature of 950° C. for a period of 2 hours in an oxidizing atmosphere comprising 200 ml/min. each of carbon dioxide and sulfur dioxide along with about 10 ml/min. of carbon monoxide. The sample at the end of the 2 hour period was cooled under a nitrogen blanket. The spheres which were recovered had a particle size of about 1000 microns.

We claim as our invention:

1. A process for the recovery of both nickel and vanadium values from a source containing said metal wherein at least one of said nickel or vanadium is present in the form of a sulfide, which process comprises concomitantly treating said source at a temperature in the range of from about 600° C. to about 1500° C. with both (1) an oxidant selected from the group consisting of carbon dioxide and water and (2) a sulfur-containing compound to convert said vanadium to an oxide form and said nickel to a nickel-nickel subsulfide form, wherein said nickel-nickel subsulfide is physically larger than said vanadium oxide and wherein said vanadium oxide is separated from said nickel-nickel subsulfide by means of said difference in size of said nickel-nickel subsulfide and said vanadium oxide.

2. The process as set forth in claim 1 in which said oxidant is carbon dioxide.

3. The process as set forth in claim 1 in which said oxidant is water.

4. The process as set forth in claim 1 in which said sulfur-containing compound is sulfur dioxide.

5. The process as set forth in claim 1 in which said sulfur-containing compound is elemental sulfur.

6. The process as set forth in claim 1 in which said separation of said nickel-nickel subsulfide from said vanadium oxide is effected by magnetic separation.

7. The process as set forth in claim 1 in which said separation of said nickel-nickel subsulfide from said vanadium oxide is effected by flotation.

8. The process as set forth in claim 1 in which said separation of said nickel-nickel subsulfide from said vanadium oxide is effected by elution.

* * * * *